United States Patent [19]

Davis, Jr.

[11] 4,066,193

[45] Jan. 3, 1978

[54] COAT HANGER SHOULDER SUPPORT ATTACHMENT

[76] Inventor: George B. Davis, Jr., 7512 Marburry Road, Bethesda, Md. 20034

[21] Appl. No.: 756,684

[22] Filed: Jan. 4, 1977

[51] Int. Cl.[2] ..... A47J 51/086

[52] U.S. Cl. ..... 223/88

[58] Field of Search ..... 223/88, 98, 85, 91, 223/87

[56] References Cited

U.S. PATENT DOCUMENTS

| | | | |
|---|---|---|---|
| 1,722,609 | 7/1929 | Unkefer | 223/88 |
| 2,123,369 | 7/1938 | Luecke | 223/88 |
| 2,535,685 | 12/1950 | Kohl et al. | 223/88 |
| 2,597,509 | 5/1952 | Mallory | 223/88 |
| 3,860,153 | 1/1975 | Davis | 223/88 |

*Primary Examiner*—George H. Krizmanich

[57] ABSTRACT

This invention relates generally to garment hangers and particularly to a shoulder support attachment for use with coat hangers of the conventional bent wire type and that is intended as a throw away device along with the wire hanger after the garment has been removed therefrom.

9 Claims, 6 Drawing Figures

COAT HANGER SHOULDER SUPPORT ATTACHMENT

Numerous shoulder support devices of this general type have been previously devised and many of which have served a useful purpose in preventing unsightly bulges forming upon the shoulders of a garment suspended from a hanger that offered too little surface support to the shoulder material for the weight of the garment suspended thereon. This is particularly true in the case of garments returned from the cleaners upon bent wire hangers where the garment is hung hot and damp from the steam press upon such hangers while the material of the shoulders is still soft and pliable. Bulges formed in this manner upon the shoulders, say of a man's coat, will alter the contour and cut of the coat and permanently disfigure the garment until again cleaned whereupon the damaging operation is repeated.

It is the object of the present invention to provide a cheap, preferably cardboard throw-away shoulder support attachment for a conventional bent wire hanger that may, when needed for a garment such as a man's coat, be sleeved over the curved ends of the hanger to lock therewith to provide a wide shoulder supporting surface for the garment as long as it rest thereon and which may thereafter be thrown away with the hanger.

A still further object is to provide an inexpensive throw-away shoulder support attachment for a conventional bent wire hanger that may be quickly and easily installed by the cleaner to lock with the hanger without the use of special tools or equipment.

A still further object is to provide a shoulder and trouser support attachment for use with a conventional wire hanger that in operation provides a wide bearing surface for the garment supported therefrom thustly eliminating the bulge upon the coat and crease upon the trousers generally accompanying the use of bare wire hangers of this type.

In order that this invention may be more readily understood, reference is now made to the accompanying drawing wherein.

Figure 1:
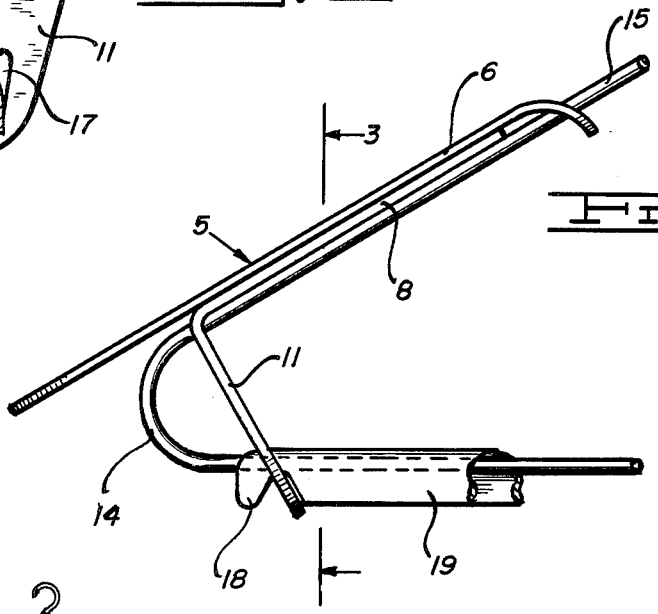
FIG. 1 is a side view in elevation of the attachment of the invention as mounted upon the end of a conventional garment hanger of the bent wire type.
Figure 2:
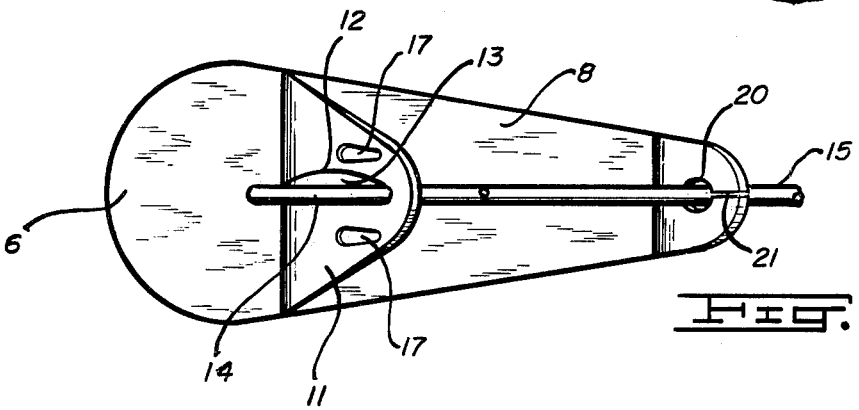
FIG. 2 is a bottom plan view, partly cut-away showing the crescent cut-through in position securing the attachment in place upon the hanger.

Refering now to the drawings and particularly to FIG. 1 thereof wherein the device 5 of the present invention is shown as comprised of a garment or shoulder supporting plate like number 6 which may be of any suitable configuration, desirably such as shown in FIG. 2. For cheapness, this plate 6 may be formed from any suitable type cardboard or thin plastic and of a thickness sufficiently pliable as to conform yieldably to the inner contour of a garment supported therefrom.

Figure 5:
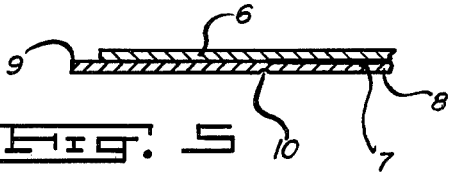
FIG. 5 shows the plates of the attachment as cemented together and showing the break point for the flange.

Partially secured as at 7, FIG. 5, to the underside of plate 6, is a second plate 8 preferably of a similar material to that of plate 6. The free end of plate 8 is so positioned with respect to plate 7 that when this extending end portion 9 thereof is manually depressed downward to break at the break line 10, there is formed thereby a depending flange 11 from plate 6 through which has been previously cut a crescent like slot 12. Through this slot is received when mounting the attachment upon a hanger, the curved end portion 14 of the hanger as shown to advantage in FIGS. 1 and 2. When the hanger end is pressed to seating position within the slot 12; the curved portion 13 of the crescent cut-through moves to the position shown to thereby effectively lock behind the curved end 14 of the hanger to positively secure the attachment to the hanger.

Further, by reason of the curved nature of slot 12, as the hanger end is forcefully inserted through the slot, the plate 6 is in a manner cammed downward and tightly against the upper surface of the hanger bar 15 and whereby the attachment is more rigidly secured in place upon the hanger. The optional cut-outs 16, and as respectively shown in FIGS. 3 and 4, may be used to provide suitable guide-like openings adjacent the slot 12 for initially receiving the curved end portion 14 of the hanger as the attachment is mounted thereon and thereby to facilitate assembly of the attachment with the hanger. These cut-outs will in no way reduce the effectiveness of the locking arrangement as provided by the crescent cut 12.

Figure 3:
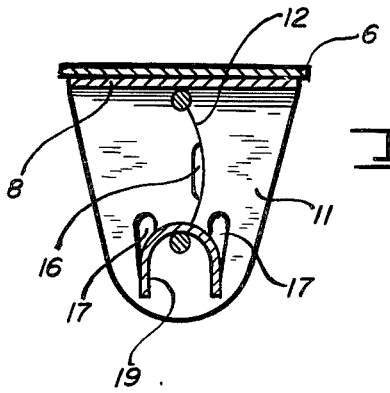
FIG. 3 shows a section as taken along 3—3 of FIG. 1 and including a modified cut-out.
Figure 6:
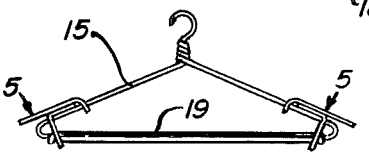
FIG. 6 shows the device as assembled with a conventional wire hanger.
Figure 4:
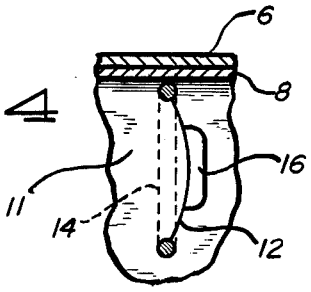
FIG. 4 is a fragmentary view in plan of the flange as modified to include an alternate cut-out from that of FIG. 3.

Formed in the flange 11 are a pair of slots 17 that are so positioned as to respectively receive the hook-like end portions 18 of a trouser support cross member 19 in the manner shown to advantage in FIGS. 1 and 3. This arrangement and securing of the cross member to the attachments 5 services, in addition to providing a wide bearing surface for trousers suspended therefrom, further serve to effectively lock the supports 5 together and thereby provide a more rugged overall assembly as apparent from FIG. 6.

To prevent snagging of a garment with the inner or small end of the plate 6, there is provided adjacent the small end thereof a hold and slot 20 and 21 respectively and which, as the attachment 5 is being mounted upon the hanger, is manually pressed over the sloping wire portion 15 of the hanger to interlock therewith in the manner shown to secure the small end of the plate to the hanger. This arrangement prevents the small end of the late bending away from the hanger to tangle with a garment being placed or removed from the hanger.

While herein is shown the plates or supporting member of the attachment as being comprised of two pieces of cardboard or the like, it is understood that this plate may be formed as a one piece fold-over if desired or as a plastic molding. Further, while herein the slot 12 is shown as a crescent cut, it is understood that this slot could be made as a straight cut-through however, it has been found that a crescent cut as herein provided is far superior by operating to cam downward the attachment tightly against the hanger and to provide a locking action with the hanger that is not possible with a straight made cut.

What I therefore claim and desire to cover by letters patent is:

1. A shoulder supporting attachment for attaching to a conventional bent wire coat hanger having sloping garment shoulder supporting surfaces connected by curved end portions to a horizontal cross-member said supporting attachment comprising, a shoulder supporting first plate having first and second ends with said first end for mounting over and extending beyond the curved end portion of the hanger, means forming a second plate secured to and forming an integral part of said first plate and including a free portion having therein a transverse crease line inwardly of said first end and a portion manually ingagable to facilitate the bending of said free portion from said first plate at said crease-line, means forming an elongated slit extending through said free portion for receiving therein the curved end of said hanger with the sides of said slit being operative to frictionally grip the sides of said hanger as the curved end portion of the hanger is forcefully inserted to seated position within said slit to form by said slitted free portion a first securing means for fastening said attachment to said hanger, means forming a second securing means extending from the integral portion of said plates at the second end thereof and manually movable into locking engagement with the sloping garment supporting surface of said hanger and cooperative with said first securing means to maintain said shoulder supporting attachment mounted over the curved outer end portion of said hanger, said first and second securing means, when free of said hanger, being movable to a position substantially coplanar with the integral portion of said plates whereby the attachment may be compacted into a substantially flat assembly for stacking one upon the other for advantageous packaging shipping and handling.

2. A shoulder support attachment as claimed in claim 1 wherein one end of the slit in said free portion extends at least to the edge of said crease-line.

3. A shoulder supporting attachment as claimed in claim 1 wherein said slit in said free portion of said second plate is of a length to effect a camming movement of the integral portion of said plates firmly against the sloping garment supporting surface of said hanger as the curved end of the hanger is forcefully inserted to seated position in said slit.

4. A shoulder supporting attachment as claimed in claim 1 wherein the free portion of said second plate includes means movable behind the curved outer end of the hanger with the curved end of the hanger in seated position in said slit.

5. A shoulder supporting attachment as claimed in claim 1 wherein said elongated slit in the free portion of the said second plate is in the configuration of a crescent cut-through with the curved portion defining one side of the crescent slit being movable behind the curved end portion of the hanger as the curved end of the hanger is forcefully inserted to seated position in said slit.

6. A shoulder supporting attachment as claimed in claim 1 including means forming a guide opening through the free portion of said second plate and intersecting said slit in inwardly spaced relation to the ends of the slit for initially receiving the curved end portion of the hanger as the latter is directed into and moved to seating position in said slit.

7. A shoulder supporting attachment as claimed in claim 1 wherein with the curved outer end of the hanger in seated position within said slit, the integral portion of said plates is caused to bear firmly against the sloping garment supporting wire surface of said hanger.

8. An improvement in a shoulder support attachment for a wire garment hanger as called for in claim 1 wherein is included means in said free portion for connecting therewith a trouser supporting cross-member operative to mechanically secure together shoulder support attachments received over the curved ends of the hanger.

9. An improvement in a shoulder support attachment for a wire garment hanger as calld for in claim 1 wherein the said means for locking behind the sloping shoulder supporting surface of said hanger is in the form of a hole and an intersecting slot movable out of the plane of said plate to lock behind the sloping wire portion of said hanger.

* * * * *